US007685689B1

(12) United States Patent
Del Castello

(10) Patent No.: US 7,685,689 B1
(45) Date of Patent: Mar. 30, 2010

(54) GARBAGE DISPOSAL INSTALLATION TOOL

(76) Inventor: Frank M. Del Castello, 3900 Mission St., San Francisco, CA (US) 94112

( * ) Notice: Subject to any disclaimer, the term of this patent is extended or adjusted under 35 U.S.C. 154(b) by 0 days.

(21) Appl. No.: 12/365,877

(22) Filed: Feb. 4, 2009

Related U.S. Application Data

(63) Continuation-in-part of application No. 11/751,248, filed on May 21, 2007, now abandoned.

(51) Int. Cl.
*B25B 27/14* (2006.01)

(52) U.S. Cl. ..... 29/281.1; 29/270; 254/133 R

(58) Field of Classification Search ..... 29/281.1, 29/252, 71, 37, 98, 271, 270; 254/2 B, 133 R, 254/134
See application file for complete search history.

(56) References Cited

U.S. PATENT DOCUMENTS

D261,794 S 11/1981 Bechtel
5,297,779 A * 3/1994 Collins et al. ..... 254/98
5,379,974 A * 1/1995 Slay et al. ..... 248/161
D396,616 S 8/1998 McCallum
6,142,460 A * 11/2000 Irwin ..... 269/60
6,618,873 B2 9/2003 Mulgrew et al.
7,024,743 B2 * 4/2006 Heaton ..... 29/271
7,140,086 B2 * 11/2006 Heaton ..... 29/271
7,401,392 B1 * 7/2008 Ramsey ..... 29/252
2007/0181864 A1 * 8/2007 Bartee ..... 254/424

OTHER PUBLICATIONS

"Garbage Disposal Information", 2006, 4 pages.
"Garbage disposal", www.wikipedia.com, Mar. 29, 2007, 3 pages; and.
"Food Waste Disposer Installation, Care & Use Manual", Emerson Inc., Mar. 21, 2002, 8 pages.

* cited by examiner

*Primary Examiner*—Lee D Wilson
(74) *Attorney, Agent, or Firm*—Ray K. Shahani, Esq.; Kin Hung Lai

(57) ABSTRACT

A garbage disposal installation tool for installing garbage disposal units under sinks providing two degrees of height adjustment that consists of a flat base portion, a hollow cylindrical housing portion that has an operable locking system attached to the base portion, a hollow cylindrical shaft portion sliding longitudinally inside the housing portion, wherein sliding position temporarily secured and locked by the locking system, a flat top platform portion having an externally threaded rod portion extending perpendicular to the top platform, and a rotatable lever bar nut having an internally threaded center through hole with screw threads matchingly corresponding with the threaded rod portion, wherein rotation of the lever bar nut causes axial motion of the externally threaded rod portion resulting in raising and lowering of the top platform portion.

14 Claims, 10 Drawing Sheets

GARBAGE DISPOSAL INSTALLATION TOOL

RELATED APPLICATIONS

This application is a Continuation-in-Part of pending U.S. patent application Ser. No. 11/751,248 filed May 21, 2007 entitled GARBAGE DISPOSAL INSTALLATION TOOL, which is incorporated herein by reference in its entirety, and claims any and all benefits to which it is entitled therefrom.

FIELD OF THE INVENTION

This invention relates to a device for installation of a garbage disposal unit under a kitchen sink or other sink more efficiently and safely.

BACKGROUND OF THE INVENTION

A garbage disposal unit is an electrically-powered device typically installed under a kitchen sink between the sink's drain and the u-trap. It shreds food waste into very small pieces so that they can be passed through the plumbing and drain pipes without clogging.

Traditionally, in one method of use, garbage disposal unit installation consists of the following steps:

1. Removing existing drainpipe, p-trap and strainer body from the sink

2. Installing a new sink flange into the drain opening and secure by the mounting ring and/or snap ring. Then tightening the mounting screws.

3. Removing the plate on the bottom of the garbage disposal unit to expose the wiring. Move the garbage disposal under the sink and connect the wires from the disposal to the power source. Lastly, connecting the ground wire from the disposal to the ground on the disposal. Replacing the plate to cover the wires.

4. Aligning the garbage disposal unit with the three mounting ears on the sink mounting assembly. Holding the garbage disposal unit in place, turning the lower mounting ring until all three mounting ears are locked into the mounting assembly.

5. Installing the discharge tube and its gasket to the garbage disposal unit. Turning the garbage disposal unit until the discharge tube aligns with the drain trap. If using a dishwasher, connecting the dishwasher tube to the garbage disposal unit.

6. Once it is installed, locking the garbage disposal unit to the sink mounting assembly using the special wrench that came with the unit.

Due to the limiting space under the kitchen sink and the usually closed structure, garbage disposal installation is typically a one-person task. Installers usually have to hold a relatively heavy garbage disposal unit in one hand and try to complete Step 3 to Step 6 with the free hand. See in particular Insinkerator™ Food Waste Disposer Installation, Care & Use Manual, Part No. 73104A-3/31/02, drawing FIG. 6-2 and related descriptive text on page 3 of the manual. Frequently installers find it difficult to maintain a secured position while trying to hold a heavy garbage disposal unit in one hand. As a result, some installers let the unit slip off their grip and drop it on the floor and causes damage to the unit or accident. Also, often installers suffer from muscle strain from holding the heavy garbage disposal unit for too long. Moreover, since the unit has to be held in a secured position throughout while installers are on their knees or squatting down, most installers tend to rush the installation process. Consequently, the garbage disposal unit might not be attached to the sink as secured as it should be.

Some installers use a stool or other sturdy subject to act as a platform to hold the garbage disposal unit during installation. However, the height of these objects is not adjustable, installers still have to hold the unit while attaching it to the bottom of the sink (Step 3 to Step 6), or raising it or lowering it. Also, it might even become a clutter that further hinders the task in a already clammed working area.

U.S. Pat. No. 7,401,392, issued Jul. 22, 2008 to Ramsey, entitled "JACK FOR SINGLE-HANDED GARBAGE DISPOSER INSTALLATION" discloses a lever jack with a platform for garbage disposal installation. Ramsey however does not teach two degrees of height adjustment, i.e. coarse and fine, as with the present invention.

U.S. Pat. No. Des. 261,794, issued Nov. 10, 1981 to Bechtel, entitled "RIFLE PEDESTAL FOR SHOOTING RANGES AND THE LIKE" discloses an height adjustable pedestal for shooting ranges and not for garbage disposal unit installation.

ADVANTAGES AND SUMMARY OF THE INVENTION

The present invention is a device and method to enhance the efficiency and safety in the garbage disposal unit installation process.

One object of the present invention is to minimizes the possibility of misalignment of garbage disposal unit and the sink mounting assembly by providing a secure and sturdy platform.

Another object of the present invention is to release the burden of holding the garbage disposal unit with one hand during installation. It will also prevent potential risks of garbage disposal unit falling off or bodily strain to installers.

Yet another object of the present invention is to increase efficiency of installation since both hands of installers are free to perform the required tasks.

Yet another object of the present invention is the adjustable height which elevates garbage disposal unit of any size to the exact position for installation.

Yet another object of the present invention is the adaptation of for all depths of sinks. Sinks ranging from 6 inches in depth, 7 inches in depth, 8 inches in depth and 10 inches in depth. The adjustable sleeve and the adjusting lever of the present invention allows two degree of control, i.e. coarse and fine, on height and can accommodate different sizes of heights of garbage disposals from 12 inches high to 13 inches high.

The present invention provides a more efficient, effective and safer way to install garbage disposal units of any size so it is useful to professional plumbers.

DETAILED DESCRIPTION OF THE PREFERRED EMBODIMENT

Figure 1:
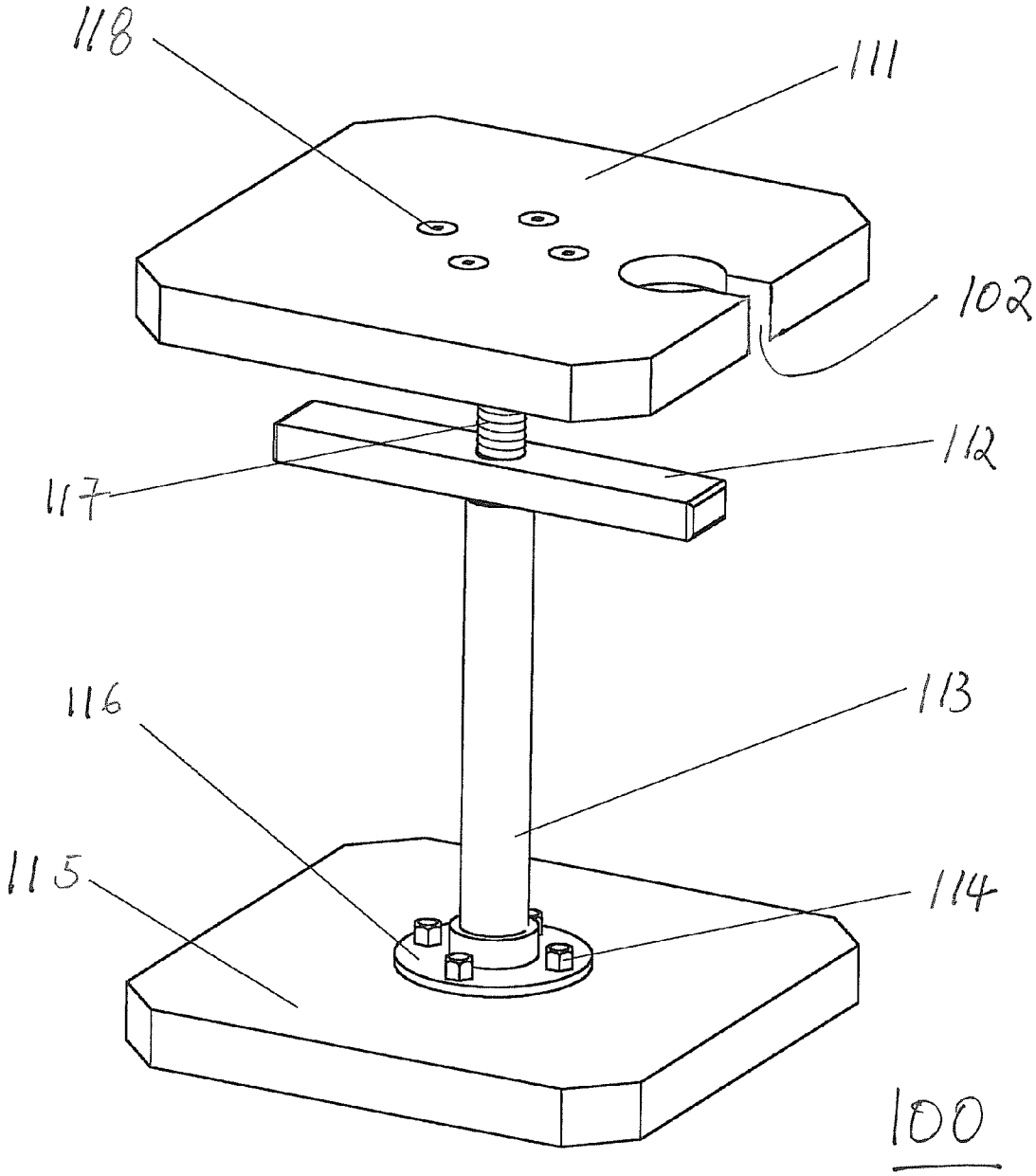
FIG. 1 is a representative top side isometric view of an embodiment of the garbage disposal installation tool 100 of the present invention.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

Figure 2:
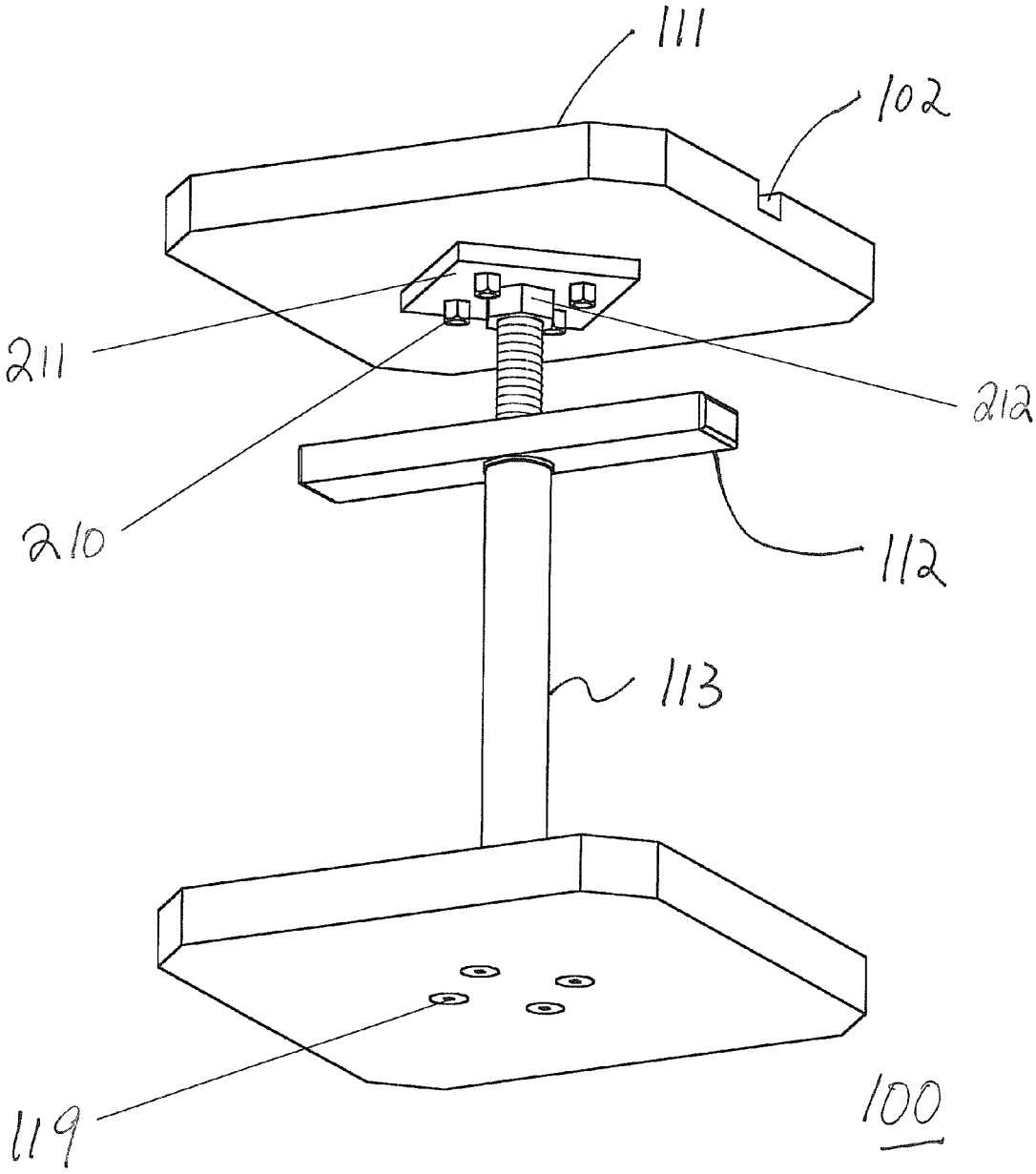
FIG. 2 is a representative bottom side isometric view of an embodiment of the garbage disposal installation tool 100 of the present invention.

FIG. 1 is a representative top side isometric view of an embodiment of the garbage disposal installation tool 100 of the present invention. FIG. 2 is a representative bottom side isometric view of an embodiment of the garbage disposal installation tool 100 of the present invention.

As shown in FIGS. 1 and 2, the garbage disposal installation tool 100 of the present invention consists of a top platform 111 with a cord notch 102 carved on its surface. In one embodiment, top platform 111 has the primary function for providing a balanced, sturdy and level support surface for any garbage disposal unit 99. In one embodiment, cord notch 102 provides a space to gather and accommodate electric code, adaptor and/or disposal cord 502 during installation.

In one embodiment, the garbage disposal installation tool of the present invention 100 provides a sturdy platform to rest the disposal unit 99 on during installation. The adjustable height of the garbage disposal installation tool of the present invention 100 ensures the garbage disposal unit 99 is at the exact position right underneath the sink (not shown) for attachment to the sink at the three mounting ears on the sink mounting assembly.

As best shown in FIG. 2, top platform 111 is secured to the elevation system 300 by plate 211 which is secured by a plurality or 4 bolts 118 and nuts 210. Plate nut 212 is located in the center of plate 211 and its main function is to secure and fasten threaded rod portion 117 to the entire top platform 111 of the garbage disposal installation tool 100 of the present invention. In one alternative embodiment, top platform 111, plate 211 and plate nut 212 can be manufactured into one integral portion without assembly by molding or other manufacturing processes. In that case, bolts 118 and nuts 212 will not be necessary.

Figure 3:
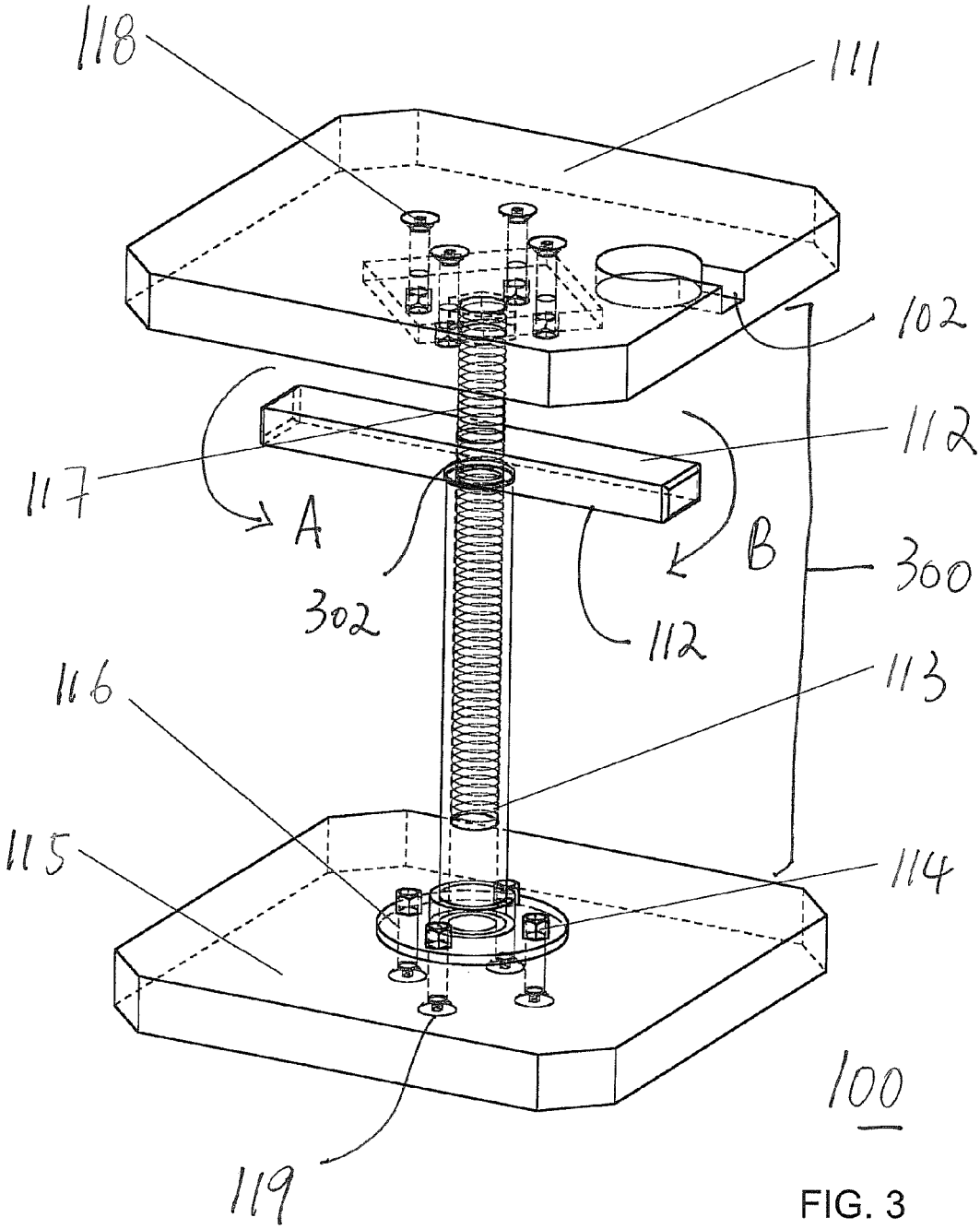
FIG. 3 is a top side expanded view of an embodiment of the garbage disposal installation tool 100 of the present invention showing the elevation system 300.
Figure 4:
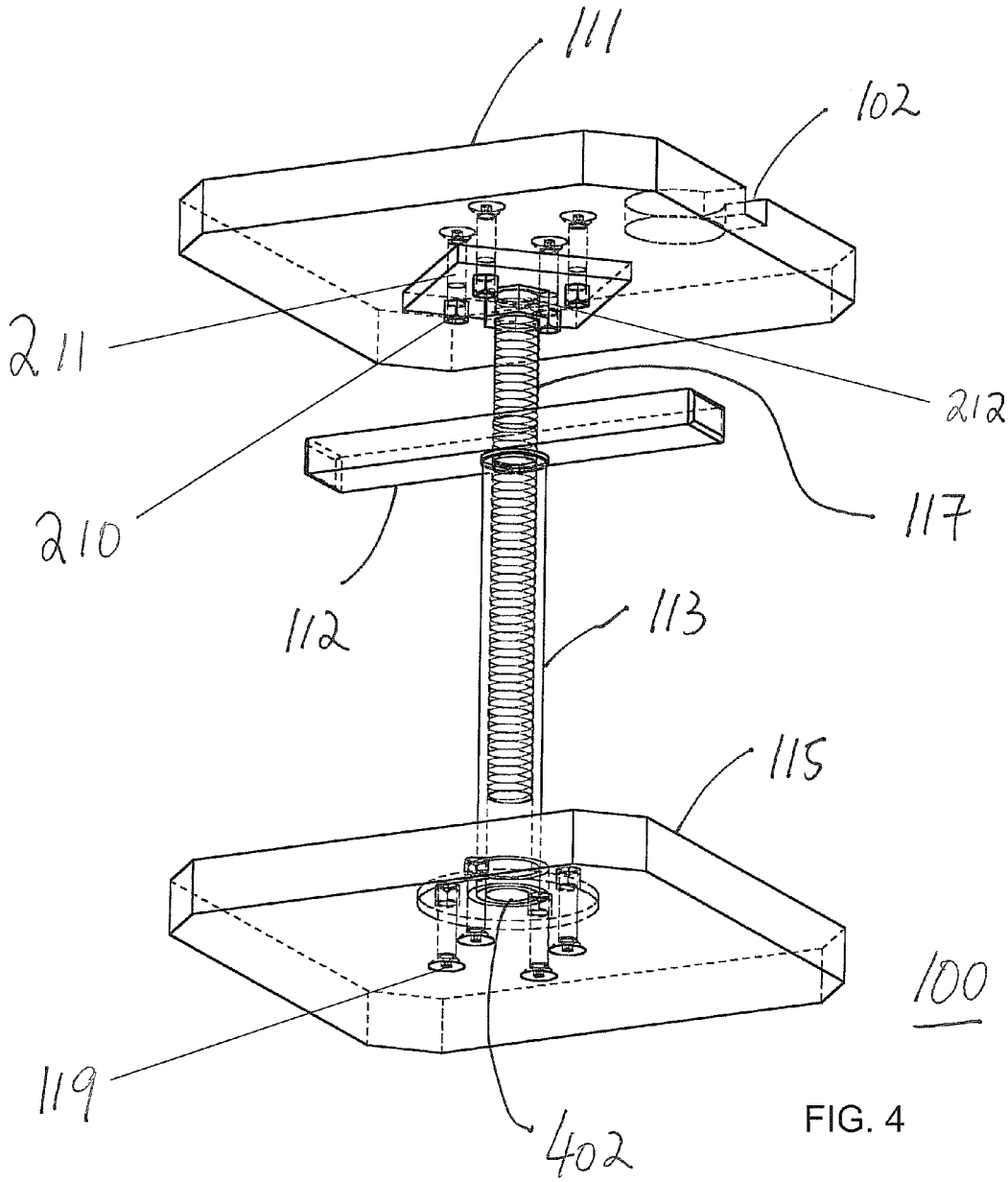
FIG. 4 is a bottom side expanded view of an embodiment of the garbage disposal installation tool 100 of the present invention showing the elevation system 300.

FIG. 3 is a top side expanded view of an embodiment of the garbage disposal installation tool 100 of the present invention showing the elevation system 300. FIG. 4 is a bottom side expanded view of an embodiment of the garbage disposal installation tool 100 of the present invention showing the elevation system 300. As shown, base platform 115 is a flat structure made of sturdy materials such as but not limited to wood, steel, aluminum, plastic, composite or equivalent rigid material, with surface area similar but not less than that of top platform 111 to avoid toppling.

As best shown in FIGS. 3 and 4, in one embodiment the elevation system 300 consists of threaded rod portion 117, adjusting lever 112 and supporting housing 113. As shown in FIGS. 3 and 4, threaded rod portion 117 is perpendicularly erected and secured at the support flange 116. Support flange 116 is secured on a flat base platform 115 by a plurality or 4 base bolts 119 and nuts 114. As shown in FIG. 4, threaded rod portion 117 is fastened to nut 212 which is part of plate 211 that is firmly secured at the bottom of top platform 111 by a plurality or 4 bolts 210. In one alternative embodiment, supporting housing 113 and flat base platform 115 can be manufactured as one integral portion, no assembly and therefore no bolts 210 will be required.

As shown in FIGS. 3 and 4, the length of threaded rod portion 117 may or may not exceed the length of support housing 113 by a large margin. In one embodiment, the length of support housing 113 is in the approximate range of 5 inch to 20 inch to be able to fit under most kitchen sinks and their surrounding structure. In one embodiment, support housing 113 takes shape of a hollow cylinder made of sturdy materials such as but not limited to steel or aluminum. The support housing 113 is optionally internally threaded. In one embodiment, threaded rod portion 117 takes the shape of an external thread which has inclined plane wrapper around the shaft. In one embodiment, threaded rod portion 117 is made of sturdy materials such as but not limited to steel or aluminum alloys and its outer circumference is less than inner circumference of support housing 113. In one embodiment, adjusting lever 112 takes shape of a square tube or bar stock made of a sturdy, rigid material. As best shown in FIG. 3, in one embodiment there is a center hole 302 in the middle of adjusting lever 112 which has the matching circumference and threads to threaded rod portion 117. Adjusting lever 112 has an operable length and thickness as may be desired. In one embodiment, adjusting lever 112 should have a minimum width of the outer diameter of support housing 113.

As best shown in FIGS. 3 and 4, adjusting lever 112 is fastened to threaded rod portion 117. In one embodiment, adjusting lever 112 is able to travel smoothly along the entire length of threaded rod portion 117 by being rotated clockwise and anti-clockwise. Once adjusting lever 112 is fastened to threaded rod portion 117, the remaining shaft of threaded rod portion 117 is inserted in the hollow support housing 113 which inner circumference is larger than the outer circumference of threaded rod portion 117 and accommodates threaded rod portion 117. As best shown in FIGS. 3 and 4, adjusting lever 112 also acts as a stopper to prevent the entire shaft of threaded rod portion 117 from being completely inserted inside support housing 113.

As best shown in FIGS. 3 and 4, in one embodiment user can simply rotate adjusting lever 112 in direction A to travel upward on the shaft of threaded rod portion 117. Consequently, it will increase the length of the portion of shaft of threaded rod portion 117 that is hidden inside the support housing 113 and subsequently decrease or lower the entire height of the top platform 111 of the garbage disposal installation tool 100 of the present invention. Conversely, to raise the top platform, user can rotate adjusting lever 112 in direction B to travel downward on the shaft of threaded rod portion 117, which will decrease the amount of the shaft of threaded rod portion 117 that is remaining inside the support housing 113 and subsequently increase the overall height of the top platform 111 of the garbage disposal installation tool 100 of the present invention. When the ideal or desired height of the top platform 111 of the garbage disposal installation tool 100 of the present invention is achieved, user can just leave the adjusting lever 112 alone and it will automatically remain in a fixed, locked position to retain the desired height of the top platform 111 of the garbage disposal installation tool 100 of the present invention. As best shown in FIG. 4, in one alternative embodiment, a center hole 402 is drilled on the upper surface of flat base platform 115 and positioned right at the base of the support housing 113. In one embodiment, center hole 402 has a depth of approximately half of the thickness of flat base platform 115 and an inside diameter and threaded inner surface matchingly corresponding with threaded rod portion 117. In one embodiment, the main function of center hole 402 is to provide a secured anchor for threaded rod portion 117 when it reaches the flat base platform 115.

Figure 5:
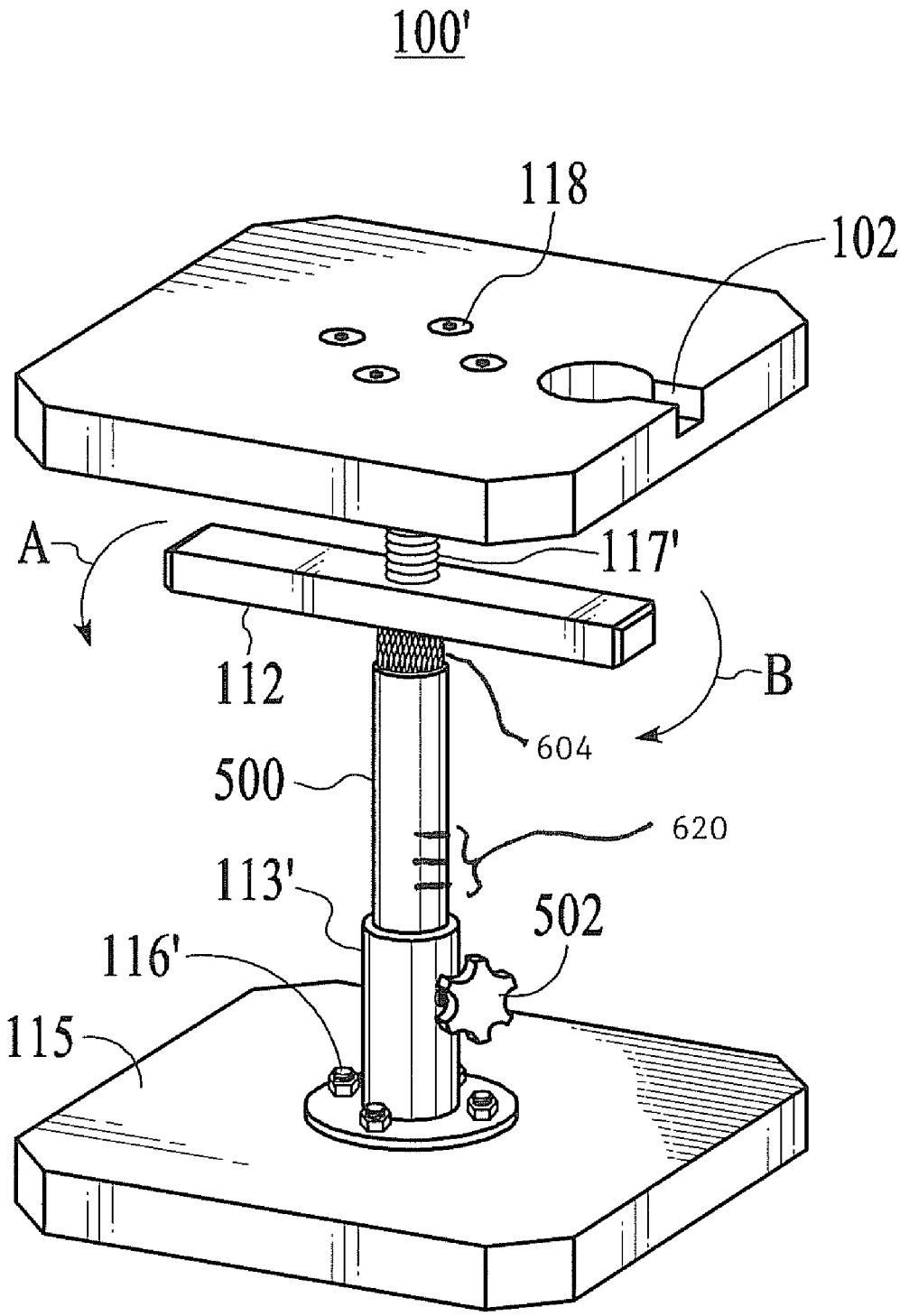
FIG. 5 is a representative top side isometric view of an alternative embodiment of the garbage disposal installation tool 100' of the present invention.
Figure 6:
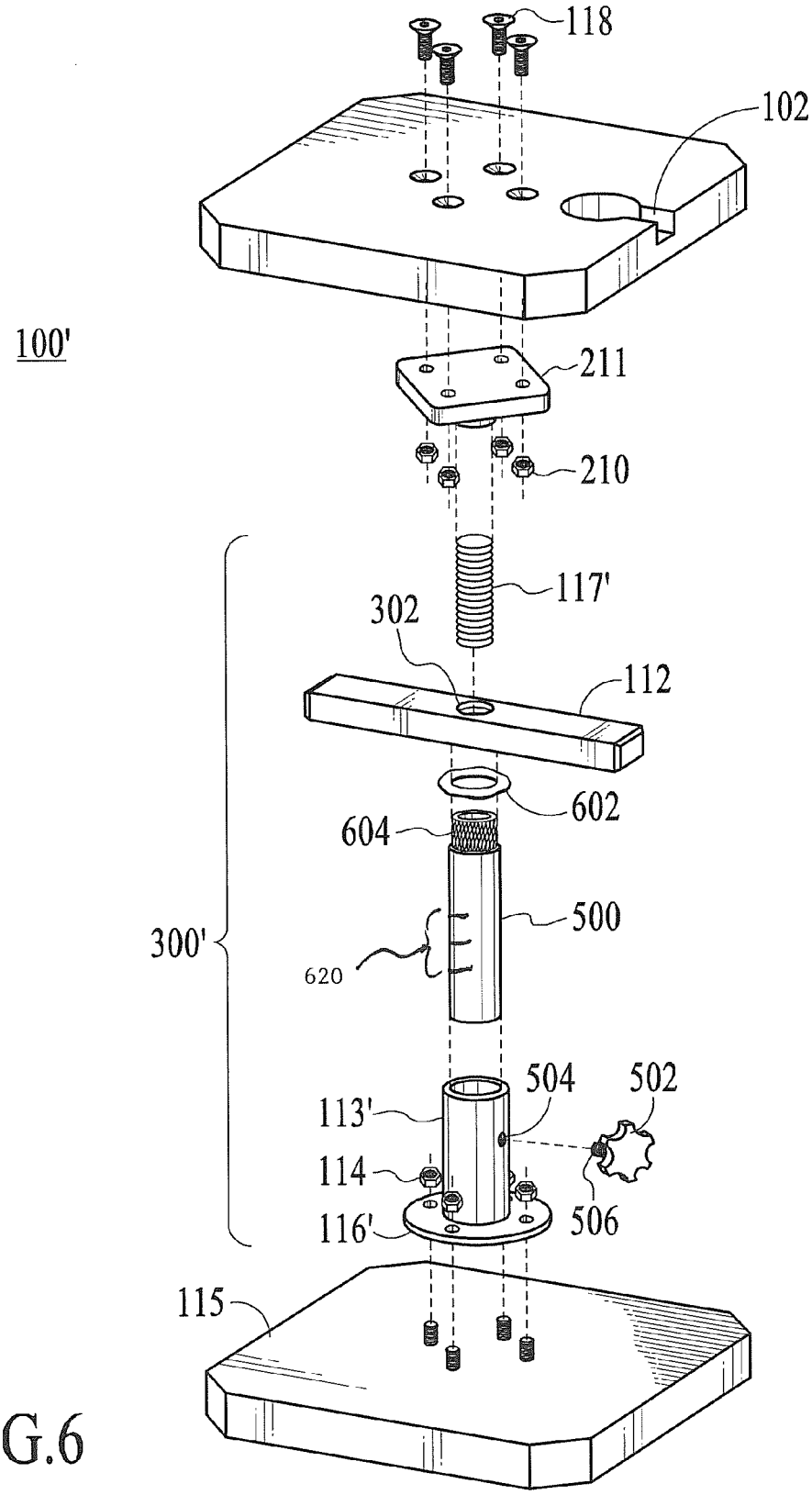
FIG. 6 is a representative exploded view of an alternative embodiment of the garbage disposal installation tool 100' of the present invention.

FIG. 5 is a representative top side isometric view of an alternative embodiment of the garbage disposal installation tool 100' of the present invention. FIG. 6 is a representative exploded view of an alternative embodiment of the garbage disposal installation tool 100' of the present invention. As shown in FIG. 6, threaded rod portion 117' is fastened to nut 212 which is part of nut plate 211 that is firmly secured at the bottom of top platform 111 by a plurality or 4 bolts 210. In one alternative embodiment, top platform 111, nut 212 and nut plate 211 can be manufactured as one integral portion, no assembly and therefore no bolts 210 will be required.

As best shown in FIGS. 5 and 6, the key difference and improvement of the alternative embodiment of garbage disposal installation tool 100' is the two-level elevation system 300'. The two-level elevation system 300' consists of threaded rod portion 117', adjusting lever 112, adjustment housing 113' and the additional element, adjustable sleeve 500. As shown in FIGS. 5 and 6, adjustment housing 113' is erected and secured by support flange 116' which subsequently is secured on flat base platform 115 by a plurality or four sets of nuts and bolts 114 and 119. In one alternative embodiment, supporting housing 113', support flange 116' and flat base platform 115 can be manufactured as one integral portion, no assembly and therefore no sets of nuts and bolts 114 and 119 will be required.

As shown in FIG. 5, the two-level elevation system 300' consists of threaded rod portion 117', adjusting lever 112, adjustment housing 113' and the additional element, adjustable sleeve 500. Adjustment housing 113' takes shape of a hollow cylinder made of sturdy materials such as but not limited to steel or aluminum. In one embodiment, there is a threaded through hole 504 on the side of adjustment housing 113'. As best shown in FIG. 6, adjustable sleeve 500 is a hollow tubular structure having an outer circumference that allows its entire structure to fit snugly but slide freely inside adjustment housing 113'. By sliding adjustable sleeve 500 along the length of the adjustment housing 113', it provides the first degree of height adjustment of the entire garbage disposal installation tool 100'. The desirable position of adjustable sleeve 500 is locked by key 502. In one embodiment, key 502 has a threaded shaft 506 having a threading pattern matchingly to that of the threaded through hole 504. By turning the key 502, threaded shaft 506 will go deeper through threaded through hole 504 until its tip touches the side of adjustable sleeve 500 and locks its position by friction. The locked position can be easily released by turning the key 502 in the opposite direction. The height adjustment by sliding adjustable sleeve 500 provide a rough adjustment to attain a desirable height of the entire garbage disposal installation tool 100'. In one embodiment, the lower tip of the cylindrical shaft portion viz. adjustable sleeve 500 has scale 620 embossed to indicate height.

In one embodiment, adjusting lever 112 takes shape of a square tube or bar stock made of a sturdy, rigid material. As best shown in FIG. 6, in one embodiment there is a center hole 302 in the middle of adjusting lever 112 which has the matching circumference and threads to threaded rod portion 117'. Adjusting lever 112 has an operable length and thickness as may be desired. In one embodiment, adjusting lever 112 should have a minimum width of the outer diameter of adjustable sleeve 500. As best shown in FIG. 6, adjusting lever 112 is fastened to threaded rod portion 117'. Adjusting lever 112 is able to travel smoothly along the entire length of threaded rod portion 117' by being rotated clockwise and anti-clockwise. Once adjusting lever 112 is fastened to threaded rod portion 117', the remaining shaft of threaded rod portion 117' is inserted in the hollow adjustable sleeve 500 which inner circumference is larger than the outer circumference of threaded rod portion 117' and accommodates threaded rod portion 117'. As best shown in FIG. 5, adjusting lever 112 also acts as a stopper to prevent the entire shaft of threaded rod portion 117' from being completely inserted inside adjustable sleeve 500.

As best shown in FIG. 5, user can simply rotate adjusting lever 112 in direction A to travel upward on the shaft of threaded rod portion 117'. Consequently, it will increase the length of the portion of shaft of threaded rod portion 117' that is hidden inside the adjustable sleeve 500 and subsequently decrease or lower the entire height of the top platform 111 of the garbage disposal installation tool 100' of the present invention. Conversely, to raise the top platform, user can rotate adjusting lever 112 in direction B to travel downward on the shaft of threaded rod portion 117', which will decrease the amount of the shaft of threaded rod portion 117' that is remaining inside the adjustable sleeve 500 and subsequently increase the overall height of the top platform 111 of the garbage disposal installation tool 100' of the present invention. In one embodiment, height markers 512 can be embossed or printed on the side of the adjustable sleeve 500 to indicate elevation height. To provide a better finger grip on the adjustable sleeve 500 during height adjustment, the upper tip of the adjustable sleeve 500 can be knurled on the outer surface. This rotation movement of the adjusting lever 112 provides a finer and second degree of height adjustment of the entire garbage disposal installation tool 100'. When the ideal or desired height of the top platform 111 of the garbage disposal installation tool 100' of the present invention is achieved, user can just leave the adjusting lever 112 alone and it will automatically remain in a fixed, locked position to retain the desired height of the top platform 111 of the garbage disposal installation tool 100' of the present invention. In summary, user will attain a rough height adjustment by sliding adjustable sleeve 500 along adjustment housing 113' and lock the position by key 502. Then user will rotate adjustment lever 112 in either direction A or B for fine adjustment until the optimal height of garbage disposal installation tool 100' is achieved.

Figure 7A:
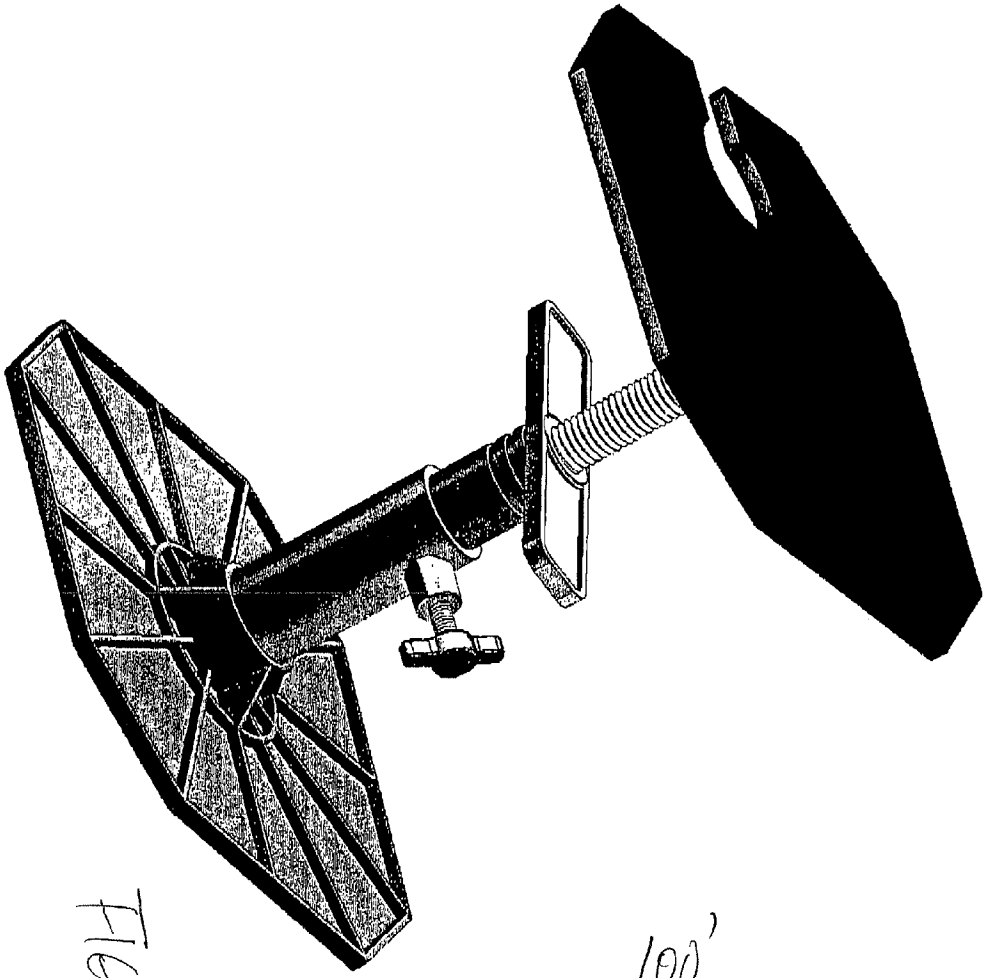
FIGS. 7A and 7B are representative isometric view of an alternative embodiment of the garbage disposal installation tool 100' in the engaging and disengaging mode respectively.
Figure 7B:
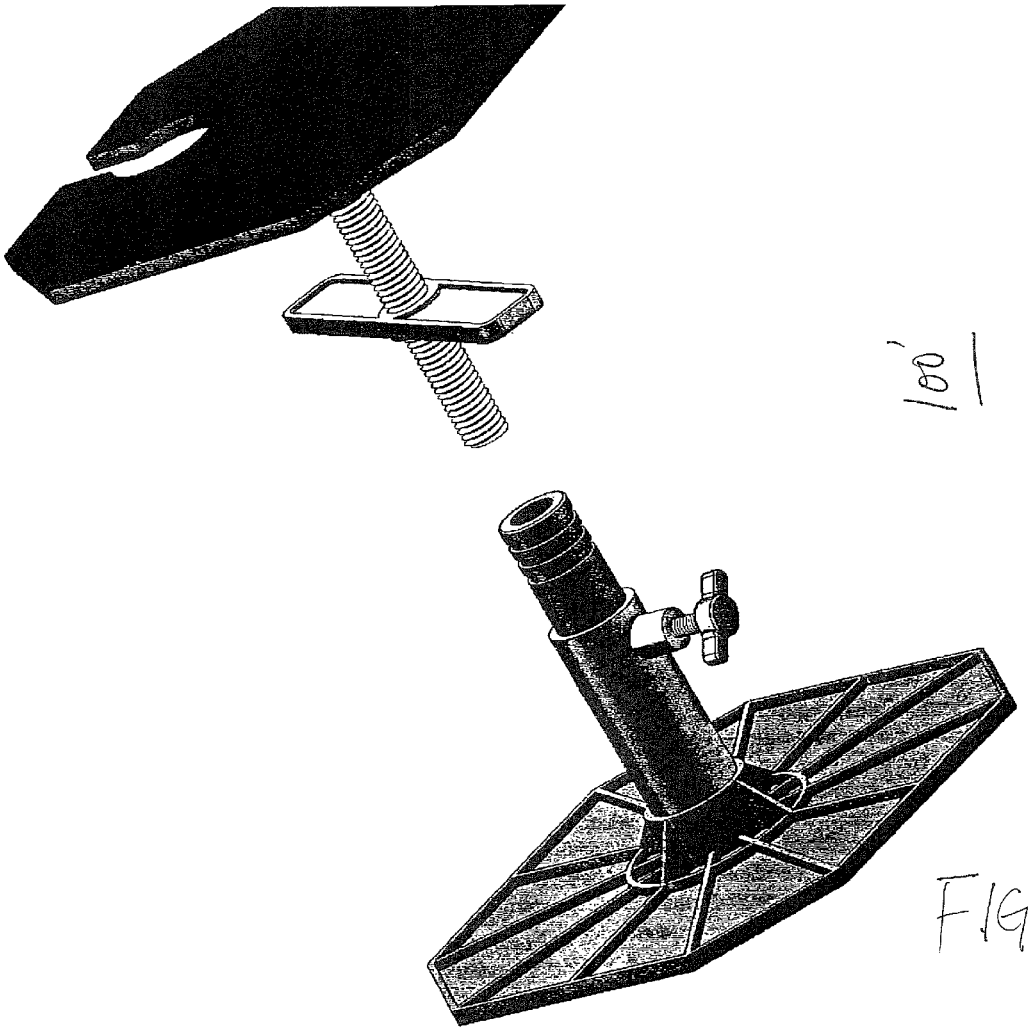
Figure 7C:
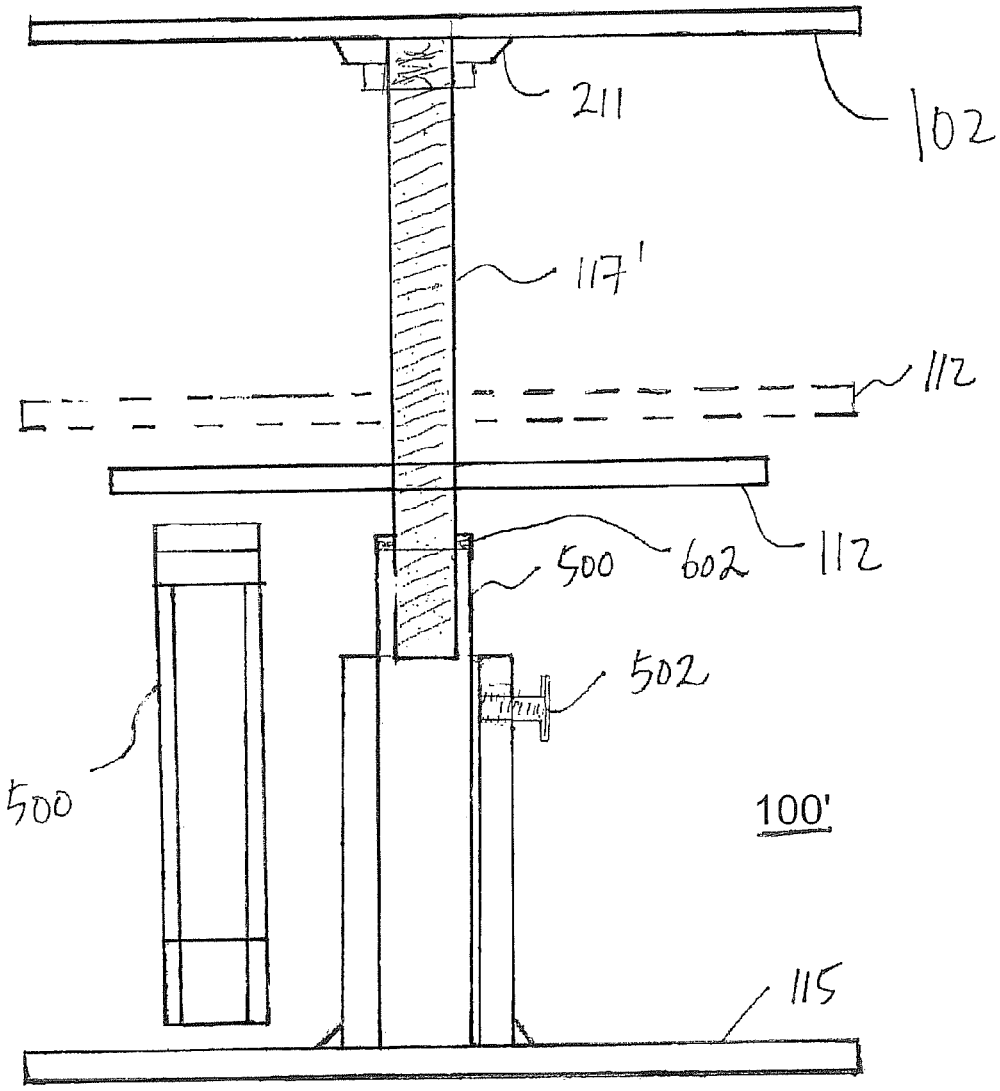
FIG. 7C is a representative cross sectional view with operational dimensions of an alternative embodiment of the garbage disposal installation tool 100'.

FIGS. 7A and 7B are representative isometric view of an alternative embodiment of the garbage disposal installation tool 100' in engaging and disengaging mode respectively. FIG. 7C is a representative cross sectional view with dimensions of an alternative embodiment of the garbage disposal installation tool 100'. As best shown in FIG. 7A, garbage disposal installation tool 100' of the present invention can be stored as one piece. In one alternative embodiment, users can take the threaded rod portion 117' out of adjustable sleeve 500 and store the unit 100' in 2 separate pieces.

As best shown in FIG. 7C, the proposed height of the adjustable sleeve 500 should be in the approximate range of 4 to 5 inches which will make the entire garbage disposal installation tool 100' accommodate most sinks in conventional kitchen ranging from 6 to 10 inches in depth and most commercial garbage disposal units 99 with height ranging from 12 to 13 inches usually. In one embodiment, operational dimensions of key parts of the garage disposal installation tool 100' are best shown in FIG. 7C. However, operation of the garbage disposal installation tool 100' will not be affected for other reasonable dimensions within the approximate range.

Figure 8:
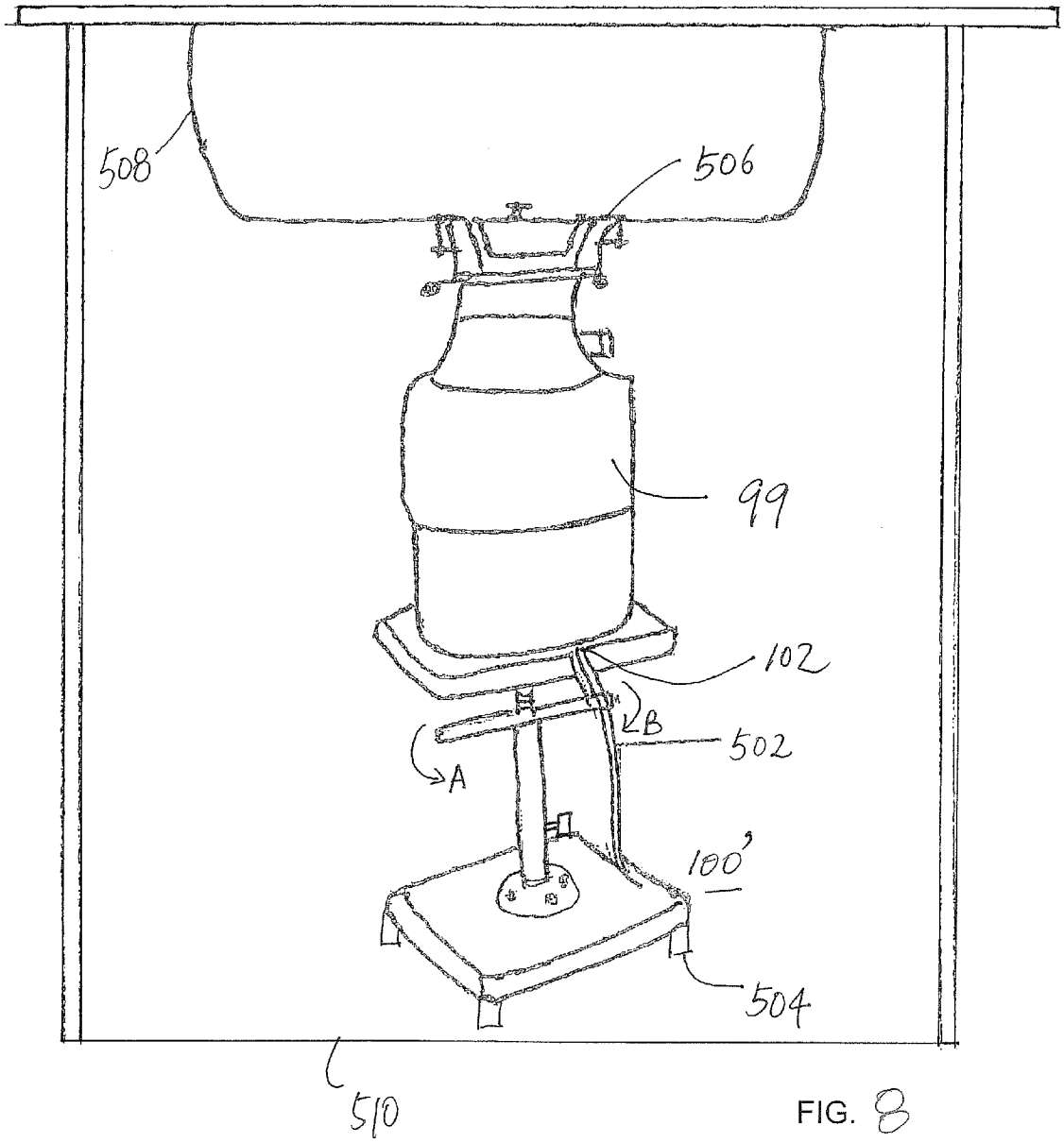
FIG. 8 shows a method of use of the garbage disposal installation tool 100' of the present invention.

FIG. 8 shows an embodiment of a method of use of the garbage disposal installation tool 100' of the present invention. Four adjustable or fixed-length legs 504 can be added under base platform 115 to ensure the levelness of top platform 111 of garbage disposal installation tool 100' during installation. In one embodiment of a method of use, user should put the garbage disposal installation tool 100' of the present invention under the sink 508 and directly underneath sink flange 506. Subsequently, user can be conservative and rotate adjusting lever 112 in direction A until most of the threaded rod portion 117 is inside support housing 113 and hence achieve the minimum height of garbage disposal installation tool 100' of the present invention. In an alternative embodiment, if user can estimate the height of garbage disposal unit 99 that to be installed, user can adjust the height of garbage disposal installation tool 100' of the present invention by rotating adjusting lever 112 in either directions to achieve a desirable distance between sink flange and top platform 111 of garbage disposal installation tool 100' of the present invention. Subsequently, user can put the heavy garbage disposal unit 99 securely on the flat surface of top platform 111 of garbage disposal installation tool 100' of the present invention.

As best shown in FIG. 8, power cable and disposal cord 502 can be gathered and secured temporarily at notch 102 to minimize hindrance during installation. User can then rotate adjusting lever 112 in direction B to elevate the top platform 111 of the garbage disposal installation tool 100' of the present invention and garbage disposal unit 99 until the top of garbage disposal unit 99 is immediate underneath sink flange 506 for installation. User can also shift garbage disposal unit 99 horizontally on surface of top platform 111 to ensure an accurate fit at the sink flange 506 and complete necessary steps to finish installation. During the entire installation, the weight of the garbage disposal unit 99 is supported and maintained at the exact height by garbage disposal installation tool 100' of the present invention and user have both free hands to complete the installation efficiently and safely. After installation, user can rotate adjusting lever 112 in direction A to lower the top platform of garbage disposal installation tool 100' of the present invention for an inch or so. Subsequently, while garbage disposal installation tool 100' of the present invention is still underneath garbage disposal unit 99, user can examine whether garbage disposal unit 99 is installed properly and securely. If the examination result is satisfactory, user can further rotate adjusting lever 112 in direction A to lower the top platform until the entire garbage disposal installation tool 100' of the present invention can be retracted from under the kitchen sink 508.

Installation steps in details as follows:

Step 1: Users install the garbage disposal unit 99 connecting the flange 506 to the bottom of the sink 508.

Step 2: Then users measure the distance from the bottom of the flange 506 to the bottom of the cabinet 510 and the height of the disposal unit 99. Then you subtract the difference and set the garbage disposal unit 99 approximately ½ to ¾ inch below the flange 506.

Step 3: Then users proceed to make sure the garbage disposal unit 99 has the electric cord attached to the garbage disposal unit 99 and the top platform portion 111 of the present invention 100' has a cord notch 102 for the cord.

Step 4: Users also make sure that the plug is knocked at the side of the garbage disposal unit 99 for a dish washer connection if applicable. Users may also attach the drain adapter to the garbage disposal unit 99 making sure it is at the correct height to receive the P tap to the drain line. After the Steps 1 through 4 preparation users then place the garbage disposal unit 99 on the top platform portion 111 and move it to the center disposal flange aligning it to the connecting ears on the disposal flange 506 to the sink 508. And then users raise the garbage disposal unit 99 by turning the adjustable lever 112 about half inch to engage the flange 506 and lock the disposal unit 99 to the flange 506 and turning the flange 506 by the ears provided on the flange 506. Then users lower the top platform portion 111 approximately half inch and remove the garbage disposal installation tool 100'. Also if users are removing the old disposal unit, they should follow the same procedure as installing the disposal 99. Users disconnect the flange 506 putting the weight on the garbage disposal installation tool 100'. In this method users only have to lift the disposal unit 99 one time setting it on the top platform portion 111. This is a novel way to accomplish the task of installing and removing a garbage disposal unit 99, manually installing it.

It will be understood that the threaded rod portion 117 and the adjusting lever 112 can be replaced with similar structure such as a worm gear, i.e., a gear consisting of a spirally threaded shaft and a wheel with marginal teeth that mesh into it.

This device is not only a novelty and it is a true and handy way to complete the installation of a sink garbage disposal. The present invention is a very simple method and not complicated. It is novel and the rather inexpensive and very much needed to install the disposal to the sink of a kitchen cabinet.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A garbage disposal installation tool for installing garbage disposal units under sinks that consists of a flat base portion, a hollow cylindrical housing portion having an operable locking system attached to the base portion, a hollow cylindrical shaft portion sliding longitudinally inside the housing portion, wherein sliding position temporarily secured by the locking system, a flat top platform portion having an externally threaded rod portion extending perpendicular to the top platform, the flat top platform further having a key shape recessed into the top platform wherein the key shape has an elongated channel ending at one side of the top platform and a second circular shape connected to the elongated channel, and a rotatable lever bar nut having an internally threaded center through hole with screw threads matchingly corresponding with the threaded rod portion, wherein rotation of the lever bar nut causes axial motion of the externally threaded rod portion resulting in raising and lowering of the top platform portion.

2. A garbage disposal installation tool for installing garbage disposal units under sinks, the garbage disposal installation tool comprising:

a rigid, stable and flat base portion having a flange attached in the center of an upper surface of the flat base portion, the flange providing an anchor point for a hollow cylindrical housing portion;

a hollow cylindrical housing portion having one end rigidly attached to the flange on the base portion, the cylindrical housing portion extending essentially perpendicular to the base portion, the cylindrical housing portion having an operable locking system;

a hollow cylindrical shaft portion sliding freely and snugly longitudinally inside the cylindrical housing portion, wherein sliding position is temporarily secured and locked by the locking system, the cylindrical shaft portion further having an upper bearing surface;

a rigid, stable and flat top platform portion having a flange attached to the center of a lower surface of the top platform portion, the top platform portion further having an upper supporting surface, the flat top platform further having a key shape recessed into the top platform wherein the key shape has an elongated channel ending at one side of the top platform and a second circular shape connected to the elongated channel, the flange attached to the top platform portion providing an anchor point for an elongated, externally threaded rod portion;

an elongated, externally threaded rod portion extending essentially perpendicular to the top platform from the flange of the top platform, the externally threaded rod portion disposed slidingly within the hollow cylindrical shaft portion; and a rotatable lever bar nut having an internally threaded center through hole with inside diameter and screw threads matchingly corresponding with the threaded rod portion, the lever bar nut portion having an upper surface and a lower bearing surface, the lever bar nut portion rotatably threaded onto the externally threaded rod portion with the lower bearing surface in intimate contact with the upper bearing surface of the hollow cylindrical shaft portion, wherein rotation of the lever bar nut portion causes axial motion of the externally threaded rod portion, resulting in raising and lowering of the top platform portion.

3. The garbage disposal installation tool of claim 2 further comprising a vinyl washer positioned between the lower bearing surface of the lever bar nut portion and the upper bearing surface of the cylindrical shaft portion for friction reduction.

4. The garbage disposal installation tool of claim 2 in which the lower tip of the cylindrical shaft portion further has scale embossed to indicate height.

5. The garbage disposal installation tool of claim 2 in which the locking system further comprising a side threaded pin hole on the cylindrical housing portion and a detachable threaded knob pin, the threaded knob pin further having a bearing tip.

6. The garbage disposal installation tool of claim 5 in which the locking system further comprising a side threaded hole on the cylindrical housing portion and a detachable threaded knob pin having a cross-sectional shape and dimension matchingly to the locking holes.

7. The garbage disposal installation tool of claim 2 in which the cylindrical shaft portion further having a plurality of identical locking holes distributed longitudinally on the side.

8. The garbage disposal installation tool of claim 2 in which the cylindrical housing portion and the elongated screw portion both have lengths of between about 10 cm and about 45 cm.

9. The garbage disposal installation tool of claim 2 in which the flat base portion further comprises a center hole at the base of the hollow cylindrical housing portion.

10. The flat base portion of claim 9 in which the center hole having a depth approximately half of the thickness of the flat base portion.

11. The flat base portion of claim 9 in which the center hole having an internal diameter and threaded surface matchingly corresponding with the threaded rod portion.

12. The garbage disposal installation too of claim 2 in which the cylindrical shaft portion further has an upper tip which is knurled on an outside surface.

13. The garbage disposal installation tool of claim 2 in which the key shape accommodates and fixes the position of at least one of the following: an utility line, waste line, drain line and power connection.

14. A garbage disposal installation tool for installing garbage disposal units under sinks that consists of a flat base portion, a hollow cylindrical housing portion having an operable locking system attached to the base portion, a hollow cylindrical shaft portion sliding longitudinally inside the housing portion, wherein sliding position temporarily secured by the locking system, a flat top platform portion having an externally threaded rod portion extending perpendicular to the top platform, the flat top platform further having a key shape recessed into the top platform, the key shape being an aperture through the to platform, wherein the key shape has an elongated channel ending at one side of the top platform and a second circular shape connected to the elongated channel, and a rotatable lever bar nut having an internally threaded center through hole with screw threads matchingly corresponding with the threaded rod portion, wherein rotation of the lever bar nut causes axial motion of the externally threaded rod portion resulting in raising and lowering of the top platform portion.

* * * * *